US007104245B2

(12) United States Patent
Robinet et al.

(10) Patent No.: US 7,104,245 B2
(45) Date of Patent: Sep. 12, 2006

(54) PRECOMBUSTION CHAMBER IGNITION DEVICE MADE OF A MATERIAL WITH HIGH THERMAL CONDUCTIVITY FOR AN INTERNAL COMBUSTION ENGINE, AND PRECOMBUSTION CHAMBER IGNITER

(75) Inventors: Cyril Robinet, Igny (FR); Nicolas Tourteaux, Rueil Malmaison (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 10/531,722

(22) PCT Filed: Oct. 17, 2003

(86) PCT No.: PCT/FR03/03083

§ 371 (c)(1),
(2), (4) Date: Apr. 18, 2005

(87) PCT Pub. No.: WO2004/036709

PCT Pub. Date: Apr. 29, 2004

(65) Prior Publication Data

US 2005/0268882 A1 Dec. 8, 2005

(30) Foreign Application Priority Data

Oct. 18, 2002 (FR) ..... 02 13017

(51) Int. Cl.
*F02B 19/18* (2006.01)
*F02B 19/00* (2006.01)
*H01T 13/54* (2006.01)

(52) U.S. Cl. ..... 123/254; 123/266; 123/270; 123/293

(58) Field of Classification Search ..... 123/254, 123/255, 266, 270, 271, 286, 293
See application file for complete search history.

(56) References Cited

U.S. PATENT DOCUMENTS

| | | | | |
|---|---|---|---|---|
| 2,047,575 A | | 7/1936 | Burtnett | |
| 2,739,578 A | * | 3/1956 | Stump | 123/286 |
| 3,892,216 A | * | 7/1975 | Danis | 123/286 |
| 4,176,649 A | * | 12/1979 | Karlovitz | 123/286 |
| 4,522,171 A | * | 6/1985 | Dworak et al. | 123/270 |
| 4,926,818 A | | 5/1990 | Oppenheim et al. | |
| 5,522,357 A | * | 6/1996 | Nogi et al. | 123/293 |

FOREIGN PATENT DOCUMENTS

| | | |
|---|---|---|
| EP | 0 896 902 A2 | 2/1999 |
| FR | 2 781 840 | 2/2000 |
| FR | 2 810 692 | 12/2001 |

* cited by examiner

*Primary Examiner*—T. M. Argenbright
(74) *Attorney, Agent, or Firm*—Nicolas E. Seckel

(57) ABSTRACT

The invention concerns an ignition device for internal combustion engine, containing:

a main chamber (1) designed for including a main combustible mixture, and fitted with a compression system of said mixture, an igniter (11) containing a precombustion chamber (2) designed for receiving reactants and an ignition system (13,14) of the reactants contained in the precombustion chamber, said precombustion chamber (2) being defined by a precombustion chamber body (12) having a head (12*a*) including at least one passageway (15), said head (12*a*) of the precombustion chamber body separating the precombustion chamber (2) from the main chamber (1) and communicating the precombustion chamber (2) and the main chamber (1) by dint of the passageway(s) (15), characterised in that said precombustion chamber body (12) is made of a material having a thermal conductivity at 20° C. of at least 10 W/K/m.

24 Claims, 2 Drawing Sheets

PRECOMBUSTION CHAMBER IGNITION DEVICE MADE OF A MATERIAL WITH HIGH THERMAL CONDUCTIVITY FOR AN INTERNAL COMBUSTION ENGINE, AND PRECOMBUSTION CHAMBER IGNITER

The present invention concerns an ignition device for internal combustion engine, as well as an igniter with precombustion chamber.

The ignition device according to the invention comprises an igniter with precombustion chamber which may be screwed instead of a conventional ignition sparking plug without any modifications of the cylinder head of the internal combustion engine (diameter smaller than or equal to 14 mm), the means for igniting an oxidant and fuel mixture being contained in a precombustion chamber defined by a body whereof the head is fitted with passageways.

Thus, when the igniter with precombustion chamber is mounted in the cylinder head of the engine, the precombustion chamber of the igniter is separate from the main combustion chamber of the engine by the head of the precombustion chamber body and communicates with the main combustion chamber by dint of the passageways provided in such head.

The igniter with precombustion chamber may possibly be fitted with means enabling to introduce directly the reactants into the precombustion chamber.

The brevet U.S. Pat. No. 4,926,818 describes a device and a method for generating pulsed jets designed to form swirling combustion pockets. The device described comprises a main chamber containing a main combustible mixture wherein a piston travels and a precombustion chamber receiving reactants and communicating with the main chamber via orifices drilled in a wall. The ignition of the reactants in the precombustion chamber generates gas jets in combustion, which ignite the main mixture contained in the main chamber by convection of the flame front.

The patent application FR 2 781 840 describes an ignition device for internal combustion engine containing:

- a main chamber designed for including a main combustible mixture, and fitted with a compression system of said mixture,
- a precombustion chamber designed for receiving reactants and communicating with the main chamber via orifices drilled in a wall separating the main chamber from the precombustion chamber,
- a system for igniting the reactants contained in the precombustion chamber.

In such a device, which proves globally satisfactory, the orifices are of small diameter and capable of preventing the propagation of a flame front while enabling the propagation of the unstable compounds derived from the combustion of the reactants contained in the precombustion chamber. The compression system and the seeding of the main mixture with unstable compounds enable mass self-ignition of the initial mixture.

The patent application FR 2 810 692 also concerns an ignition device for internal combustion engine including a precombustion chamber generally cylindrical in shape, similar to that described in the application FR 2 781 840, but whereof the passageways communicating with the main combustion chamber are circumscribed by a circular curve running through the centres of the outermost passageways, the diameter of such circular curve being in a ratio smaller than or equal to ½ with the diameter of the cylindrical precombustion chamber. Such an arrangement enables the operation of the engine with a small quantity of oxidant air, in particular when the composition of the air-fuel mixture in the main chamber is stoichiometric, for depollution purposes with a three-way catalyst.

Such devices may still be improved.

Notably, the present invention concerns an ignition device for internal combustion engine which may exhibit the following advantages:

- reduced enrichment in fuel of the air-fuel mixture when the engine operates on full load,
- reduction, possibly suppression of the pinkling, which enables to increase the volumetric ratio of the engine,
- better productivity of usage of the oxidant and of the fuel.

To this end, the invention concerns an ignition device for internal combustion engine, containing:

- a main chamber designed for including a main combustible mixture, and fitted with a compression system of said mixture,
- an igniter containing a precombustion chamber designed for receiving reactants and an ignition system of the reactants contained in the precombustion chamber, said precombustion chamber being defined by a precombustion chamber body having a head including at least one passage, said head of the precombustion chamber body separating the precombustion chamber from the main chamber and communicating the precombustion chamber and the main chamber by dint of the passageway(s).

According to the invention, said precombustion chamber body is made of a material having a thermal conductivity at 20° C. of at least 10 W/K/m.

Preferably, the precombustion chamber body is made of a material having a thermal conductivity at 20° C. of at least 30 W/K/m, better of at least 50 W/K/m.

Generally, the thermal conductivity at 20° C. of the material composing the body of the precombustion chamber does not exceed 350 W/K/m.

To realise the precombustion chamber body according to the invention, one may use any type of material whereof the thermal conductivity is as defined previously and which is capable of resisting the temperature and pressure constraints due to the operation of the ignition device.

Notably, one may use copper alloys. Preferably, the material forming the precombustion chamber body according to the invention is selected among binary brasses, copper-nickel, copper-aluminium and copper-nickel-zinc alloys.

One may quote in particular the alloys CuZn5, CuZn10, CuZn15, CuZn20, CuZn30, CuZn33, CuZn36, CuZn37, CuZn40, CuNi44Mn, CuNi5Fe, CuAl5, CuAl6, CuAl10Fe5Ni5, CuNi10Zn27, CuNi12Zn24, CuNi15Zn21, CuNi18Zn20, CuNi18Zn27, CuNi10Zn42Pb2 and CuNi18Zn19Pb1, preferably the alloy CuZn5 whereof the thermal conductivity at 20° C. is 234 W/(m.K). The composition of these alloys is given by the standard NF A51-101

A material particularly preferred for the precombustion chamber body according to the invention is the alloy CuCr1Zr, whereof the thermal conductivity at 20° C. is 320 W/K/m. Such alloy includes, in weight, more than 0.4% chrome, 0.02 to 0.1% zirconium, the complement to 100% being copper.

These high thermal conductivity alloys are particularly suited to precombustion chamber igniters intended for use with heavily supercharged internal combustion engines, i.e. having an Average Effective Pressure greater than or equal to 13 bars. One may quote for instance the engines for compressors or turbo-compressors.

The use of such al material according to the invention enables better evacuation of the energy to the body of the precombustion chamber and thus to prevent hot points from appearing.

The combustion mode resulting from the use of the ignition device according to the invention ensures sufficient combustion speed to dispense with an increased combustion speed via aerodynamics.

This enables in particular to reduce considerably the pinkling effect. Such reduced pinkling is compatible with high volumetric ratio of the engine, advantageously ranging between 8 and 14.

Moreover, such reduced pinkling enables better productivity of usage of the oxidant and of the fuel.

Indeed, when the engine is limited by the pinkling (in particular on high load), i.e. when the too small combustion speed enables to reach in certain portions of the chamber, the conditions of self-ignition of the mixture before said portions have been burnt by the flame front, the adjustment applied, in terms of advance, to the ignition is degraded with respect to the optimum case. The quantity of air and of fuel introduced into the combustion chamber is not used with optimum yield.

When the pinkling phenomenon is inhibited, it is possible to adjust the engine with an ignition advance closer to optimum yield, which enables better use of the oxidant and of the fuel.

According to a first embodiment, the ignition of the main mixture contained in the main chamber takes place by convection of the flame front derived from the ignition of the reactants contained in the precombustion chamber.

In such a case, the passageway(s) are preferably of cylindrical shape and of diameter greater than 1 mm.

According to a second embodiment, the passageway(s) are capable of preventing the propagation of a flame front while enabling the propagation of unstable compounds derived from the combustion of the reactants contained in the precombustion chamber, the compression system of the main chamber and the seeding of the main mixture with said unstable compounds enabling mass self-ignition of the main mixture.

The self-ignition in a large volume enables very quick pressure rise, reduced pinkling and good repeatability.

In such a case, said passageway(s) are preferably of cylindrical shape and of diameter smaller than or equal to 1 mm.

Preferably still, said passageway(s) have a length smaller than or equal to the diameter thereof. By length is meant the dimension of the passageways according to a direction perpendicular to the surface of the separation wall. This way, the smallest possible quantity of unstable compounds is trapped to the walls.

Generally, the number of passageway(s) ranges between 1 and 20, preferably between 3 and 15.

In the case of self-ignition of the mixture by seeding of the main mixture with unstable compounds, according to a preferred embodiment:

- the upper section of the body of precombustion chamber, not adjoining the main chamber, is in the form of a cylinder of inner diameter $\phi$, and
- the head of the precombustion chamber body comprises several passageways, said passageways being circumscribed by a circular curve of diameter $d_2$ running through the centres of the outermost passageways, the ratio $d_2/\phi$ being smaller than or equal to 0.5.

Preferably, the ratio $d_2/\phi$ is smaller than or equal to ⅓.

Advantageously, the centre of the curve running through the centres of the outermost passageways is situated on the axis symmetry of the precombustion chamber.

But, according to another embodiment, the centre of the curve running through the centres of the outermost passageways may be situated at a distance $d_3$ from the axis symmetry of the precombustion chamber, equal to or greater than a quarter of the diameter $\phi$ of the precombustion chamber. Such configuration enables to direct preferably the jets of flames or of unstable compounds towards a particular zone of the combustion chamber, in relation to the position of said centre of the curve with respect to the axis symmetry of the precombustion chamber.

The invention still concerns an igniter for internal combustion engine containing a precombustion chamber defined by a precombustion chamber body having a head fitted with at least one passageway, the precombustion chamber being designed for including a combustible mixture, and an ignition system of the combustible mixture contained in the precombustion chamber, said precombustion chamber body being made of a material having a thermal conductivity at 20° C. of at least 10 W/K/m, preferably of at least 30 W/K/m, better of at least 50 W/K/m, and smaller than or equal to 350 W/K/m.

Preferably, the precombustion chamber body is made of copper alloy. preferably Still, the material forming the precombustion chamber body according to the invention is selected among binary brasses, copper-nickel, copper-aluminium and copper-nickel-zinc alloys.

One may quote in particular the alloys CuZn5, CuZn10, CuZn15, CuZn20, CuZn30, CuZn33, CuZn36, CuZn37, CuZn40, CuNi44Mn, CuNi5Fe, CuAI5, CuAl6, CuAl10Fe5Ni5, CuNi10Zn27, CuNi12Zn24, CuNi15Zn21, CuNi18Zn20, CuNi18Zn27, CuNi10Zn42Pb2 and CuNi18Zn19Pb1, preferably the alloy CuZn5 whereof the thermal conductivity at 20° C. is 234 W/(m.K).

A material particularly preferred for the precombustion chamber body of the igniter according to the invention is the alloy CuCr1Zr, whereof the thermal conductivity at 20° C. is 320 W/K/m.

The invention will be understood better and other aims, advantages and features thereof will appear more clearly when reading the following description, in conjunction with the appended drawings.

Figure 1:
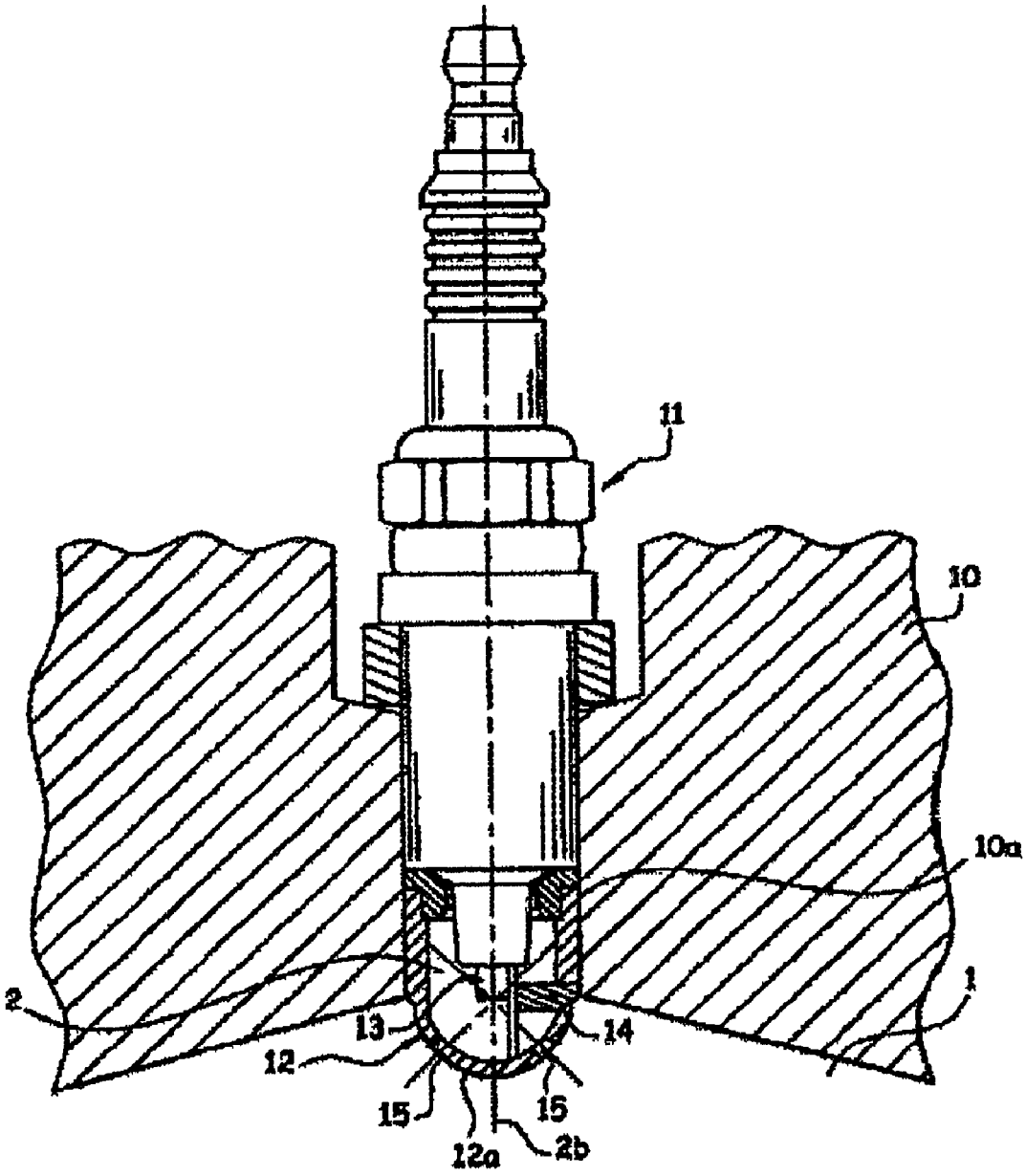
FIG. 1 represents a schematic, partially sectional view, of an ignition device including an igniter with precombustion chamber according to the invention.

A cylinder of an internal combustion engine, represented on FIG. 1, includes a main chamber 1 delineated by a jacket (not represented) and closed at the upper section thereof by a cylinder head 10. As usual, the main chamber 1 contains a piston (not represented) actuated in translation by a rod (not represented).

An igniter 11 with precombustion chamber according to the invention is attached in the cylinder head 10 in order to be adjoining the main chamber 1, for instance by screwing in a thread 10*a* of the cylinder head 10.

The igniter 11 includes a precombustion chamber body 12, generally tubular in shape, containing a head 12*a*, preferably having the form of a spherical cap, defining a precombustion chamber 2.

The head 12*a* of the precombustion chamber body 12 forms a separation wall between the main chamber 1 and the precombustion chamber 2. The head 12*a* communicates the precombustion chamber 2 with the main chamber 1 by dint of passageways (15).

The precombustion chamber body 12 is made of a material having a thermal conductivity at 20° C. of at least 10 W/K/m, preferably of at least 20 W/K/m, better of at least 50 W/K/m. Generally, the thermal conductivity at 20° C. of the material composing the precombustion chamber body does not exceed 350 W/K/m. Advantageously, the precombustion chamber body 12 is made of the alloy CuCr1Zr, whereof the thermal conductivity at 20° C. is 320 W/K/m.

Generally, the precombustion chamber 2 has a volume ranging between 0.2 $cm^3$ and 2 $cm^3$, preferably ranging between 0.5 $cm^3$ and 1.5 $cm^3$.

Generally, the ratio SN between the sum of the sections of the passageways 15 of the precombustion chamber and the volume of the precombustion chamber ranges between $10^{-3}$ $mm^{-1}$ and $5.10^{-2}$ $mm^{-1}$.

Optionally, the igniter may moreover include an intake (not represented) enabling to supply the precombustion chamber 2 with a mixture of air-fuel reactants formed upstream or to introduce fuel, the air being mixed with fuel in the precombustion chamber 2.

The precombustion chamber is fitted with an ignition system containing a central electrode 13 and a ground electrode 14. The inter-electrode space is for instance of the order of 0.7 mm.

When the ignition of the main mixture takes place by convection of the flame front from the precombustion chamber, the passageways 15 are orifices having preferably a diameter greater than 1 mm.

To prevent, at ignition, the propagation of a flame front while letting through unstable compounds (ignition of the main mixture by self-ignition), the passageways 15 have then a small diameter, generally smaller than 1 mm, and, advantageously, a length smaller than the diameter thereof.

Figure 2:
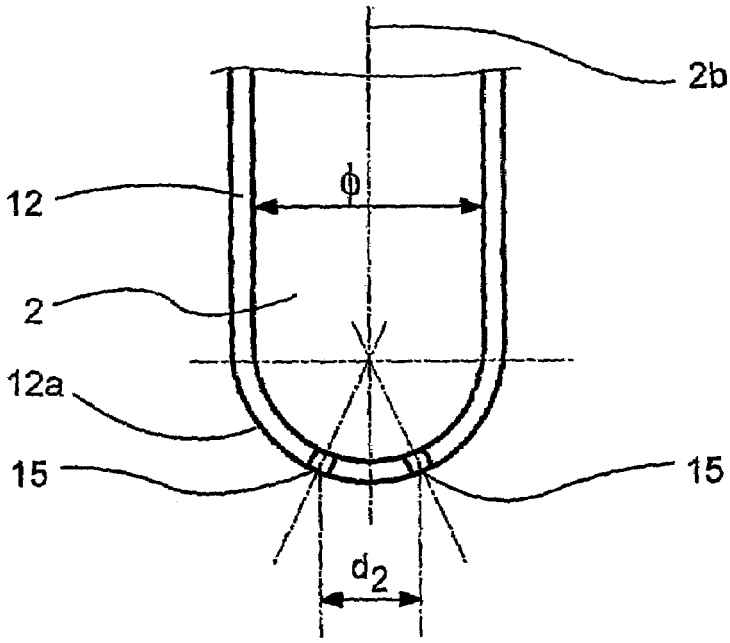
FIG. 2 represents a schematic, vertically sectional view of the precombustion chamber body of an igniter according to the invention.

In the case of self-ignition of the main mixture, as shown on FIG. 2, the passageways 15 belong advantageously to a circle of diameter $d_2$ corresponding substantially to half the diameter $\phi$ of the precombustion chamber.

The centre of this circle may be on the axis symmetry 2*b* of the precombustion chamber 2, as shown on FIG. 2.

Figure 3:
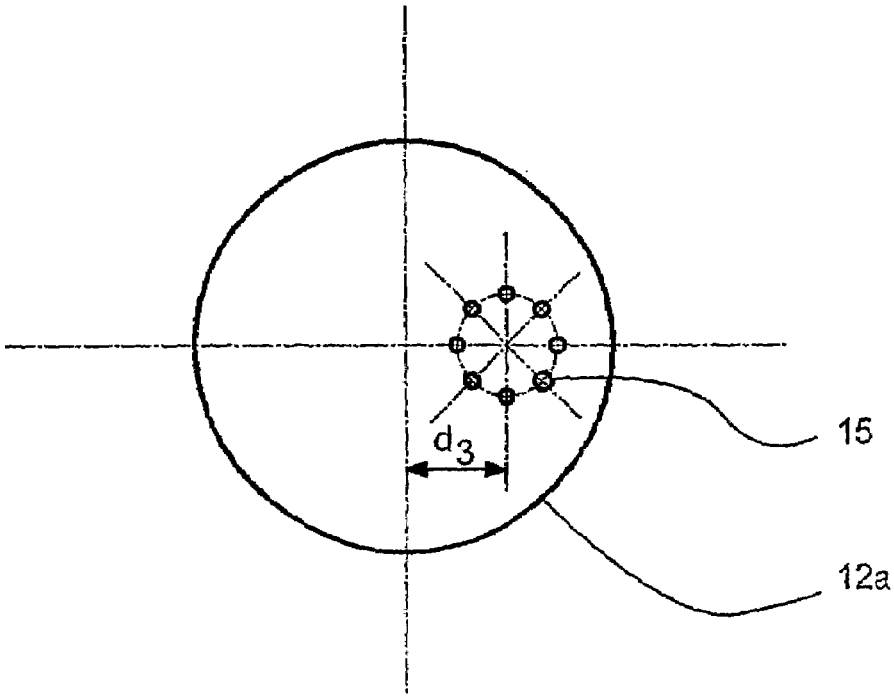
FIG. 3 is a view from beneath of the head of a precombustion chamber body of an igniter according to the invention.

The centre of this circle may also be situated at a distance $d_3$ from the axis symmetry 2*b* of the precombustion chamber 2, as shown on FIG. 3, whereon passageways 15, 8 in number, have been represented.

One injects an air-fuel mixture in the main chamber and one supplies the precombustion chamber 2. One then produces a spark between the electrodes 13 and 14 while triggering thus the combustion in the precombustion chamber 2, so that the temperature and the pressure increase therein.

Under the effect of the higher pressure in the precombustion chamber 2 than in the main chamber 1, the flames, or the unstable compounds in the case or the dimension of the passageways prevents the propagation of the flame front, are expelled in the form of jets towards the main chamber 1. Thus the main mixture contained in the main chamber 1 is ignited.

In both cases (ignition of the main mixture by convection of the flame front or by self-ignition), the high thermal conductivity of the precombustion chamber body enables evacuation of the energy at the precombustion chamber body and thus to prevent hot points from appearing.

The resulting combustion mode ensures sufficient combustion speed to dispense with an increased combustion speed via aerodynamics.

One may thus reduce the enrichment when the engine operates on full load. One also reduces considerably the pinkling phenomenon.

The invention claimed is:

1. An ignition device for internal combustion engine, containing:

a main chamber designed for including a main combustible mixture, and fitted with a compression system of said mixture, an igniter containing a precombustion chamber designed for receiving reactants and an ignition system of the reactants contained in the precombustion chamber, said precombustion chamber being defined by a precombustion chamber body having a head including at least one passageway, said head of the precombustion chamber body separating the precombustion chamber from the main chamber and communicating the precombustion chamber and the main chamber by dint of the passageway(s), wherein said precombustion chamber body is made of a material selected among copper alloys and having a thermal conductivity at 20° C. of at least 10 W/K/m.

2. An ignition device according to claim 1, wherein said precombustion chamber body is made of a material having a thermal conductivity at 20° C. of at least 30 W/K/m.

3. An ignition device according to claim 1, wherein said precombustion chamber body is made of a material having a thermal conductivity at 20° C. smaller than or equal to 350 W/K/m.

4. An ignition device according to claim 1, wherein the material forming the precombustion chamber body according to the invention is selected among binary brasses, copper-nickel, copper-aluminium and copper-nickel-zinc alloys.

5. An ignition device according to claim 4, wherein the material forming the precombustion chamber body according to the invention is selected among the alloys CuZn5, CuZn10, CuZn15, CuZn20, CuZn30, CuZn33, CuZn36, CuZn37, CuZn40, CuNi44Mn, CuNi5Fe, CuAl5, CuAl6, CuAl10Fe5Ni5, CuNi10Zn27, CuNi12Zn24, CuNi15Zn21, CuNi18Zn20, CuNi18Zn27, CuNi10Zn42Pb2 and CuNi18Zn19Pb1.

6. An ignition device according to claim 1, wherein the material forming said precombustion chamber body is CuCr1Zr.

7. An ignition device according to claim 1, wherein said passageway(s) are of cylindrical shape and of diameter greater than 1 mm.

8. An ignition device according to claim 1, wherein said passageway(s) are capable of preventing the propagation of a flame front while enabling the propagation of unstable compounds derived from the combustion of the reactants contained in the precombustion chamber, the compression system of the main chamber and the seeding of the main mixture with said unstable compounds enabling mass self-ignition of the main mixture.

9. An ignition device according to claim 8, wherein said passageway(s) are of cylindrical shape and of diameter smaller than or equal to 1 mm.

10. An ignition device according to claim 8, wherein said passageway(s) have a length smaller than or equal to the diameter thereof.

11. An ignition device according to claim 8, wherein the upper section of the precombustion chamber body, not adjoining the main chamber, is in the form of a cylinder of inner diameter $\phi$, and the head of the precombustion chamber body comprises several passageways, said passageways being circumscribed by a circular curve of diameter $d_2$ running through the centres of the outermost passageways, the ratio $d_2/\phi$ being smaller than or equal to 0.5.

12. An ignition device according to claim 11, wherein the ratio $d_2/\phi$ is smaller than or equal to ⅓.

13. An ignition device according to claim 11, wherein the centre of the curve running through the centres of the outermost passageways is situated on the axis symmetry of the precombustion chamber.

14. An ignition device according to claim 11, wherein the centre of the curve running through the centres of the outermost passageways is situated at a distance $d_3$ from the axis symmetry of the precombustion chamber, said distance $d_3$ being equal to or greater than a quarter of the diameter $\phi$ of the precombustion chamber.

15. An igniter for internal combustion engine containing a precombustion chamber defined by a precombustion chamber body having a head fitted with at least one passageway, the precombustion chamber being designed for including a combustible mixture, and an ignition system of the combustible mixture contained in the precombustion chamber, wherein the precombustion chamber body is made of a material selected from copper alloys and having a thermal conductivity greater than 10 W/K/m.

16. An igniter according to claim 15, wherein said precombustion chamber body is made of a material having a thermal conductivity greater than 10 W/K/m.

17. An igniter according to claim 15, wherein said precombustion chamber body is made of a material having a thermal conductivity smaller than or equal to 350 W/K/m.

18. An igniter according to claim 15, wherein the material forming said precombustion chamber body is selected among the binary brasses, copper-nickel, copper-aluminium and copper-nickel-zinc alloys.

19. An igniter according to claim 18, wherein the material forming said precombustion chamber body is selected among the alloys CuZn5, CuZn10, CuZn15, CuZn20, CuZn30, CuZn33, CuZn36, CuZn37, CuZn40, CuNi44Mn, CuNi5Fe, CuAl5, CuAl6, CuAl10Fe5Ni5, CuNi10Zn27, CuNi12Zn24, CuNi15Zn21, CuNi18Zn20, CuNi18Zn27, CuNi10Zn42Pb2 and CuNi 18Zn19Pb1.

20. An igniter according to claim 15, wherein the material forming said precombustion chamber body is the alloy CuCrlZr.

21. An ignition device for internal combustion engine, containing:

a main chamber designed for including a main combustible mixture, and fitted with a compression system of said mixture, an igniter containing a precombustion chamber designed for receiving reactants and an ignition system of the reactants contained in the precombustion chamber, said precombustion chamber being defined by a precombustion chamber body having a head including at least one passageway, said head of the precombustion chamber body separating the precombustion chamber from the main chamber and communicating the precombustion chamber and the main chamber by dint of the passageway(s), wherein said precombustion chamber body is made of a material having a thermal conductivity at 20° C. of at least 10 W/K/m, wherein said passageway(s) are capable of preventing the propagation of a flame front while enabling the propagation of unstable compounds derived from the combustion of the reactants contained in the precombustion chamber, the compression system of the main chamber and the seeding of the main mixture with said unstable compounds enabling mass self-ignition of the main mixture, and wherein the upper section of the precombustion chamber body, not adjoining the main chamber, is in the form of a cylinder of inner diameter $\phi$, and the head of the precombustion chamber body comprises several passageways, said passageways being circumscribed by a circular curve of diameter $d_2$ running through the centres of the outermost passageways, the ratio $d_2/\phi$ being smaller than or equal to 0.5.

22. An ignition device according to claim 21, wherein the ratio $d_2/\phi$ is smaller than or equal to ⅓.

23. An ignition device according to claim 21, wherein the centre of the curve running through the centres of the outermost passageways is situated on the axis symmetry of the precombustion chamber.

24. An ignition device according to claim 21, wherein the centre of the curve running through the centres of the outermost passageways is situated at a distance $d_3$ from the axis symmetry of the precombustion chamber, said distance $d_3$ being equal to or greater than a quarter of the diameter $\phi$ of the precombustion chamber.

* * * * *